United States Patent [19]

Cormier et al.

[11] 4,265,442

[45] May 5, 1981

[54] CASSETTE LOCKING AND ALIGNMENT ASSEMBLY

[75] Inventors: Raymond G. Cormier, Nashua, N.H.; Walter C. Allen, Ipswich, Mass.

[73] Assignee: Nashua Corporation, Nashua, N.H.

[21] Appl. No.: 76,310

[22] Filed: Sep. 17, 1979

[51] Int. Cl.[3] ..... B65H 3/06; B65H 1/12

[52] U.S. Cl. ..... 271/127; 271/160; 271/164; 271/170

[58] Field of Search ..... 271/117, 127, 145, 160, 271/162, 170, 171, 164

[56] References Cited

U.S. PATENT DOCUMENTS

| | | | |
|---|---|---|---|
| 3,689,064 | 9/1972 | Kuksa | 271/127 X |
| 3,758,105 | 9/1973 | Okamoto . | |
| 3,977,666 | 8/1976 | Suzuki et al. | 271/127 X |
| 4,032,137 | 6/1977 | Katayma et al. . | |
| 4,060,233 | 11/1977 | Stange et al. | 271/127 X |

FOREIGN PATENT DOCUMENTS

| | | | |
|---|---|---|---|
| 2856541 | 7/1979 | Fed. Rep. of Germany | 271/145 |
| 2900159 | 7/1979 | Fed. Rep. of Germany | 271/160 |

*Primary Examiner*—Bruce H. Stoner, Jr.
*Attorney, Agent, or Firm*—Kenway & Jenney

[57] ABSTRACT

A tray with a ramp plate is insertable into a tray receiving assembly of a photocopier. The assembly includes an opening up through which a lift member is moveable for engaging the bottom of the ramp plate through an opening in the tray bottom when the tray is inserted. A locking bracket is pivotable to a position extending through the assembly opening to engage the bottom of the tray. A locking handle is linked to a shaft carrying the lift roller to hold the lift member in a disengaged position in which it keeps the locking bracket in a disengaged position. The base of the tray includes an elongate projection with a protruding upper surface about which the rear edge of the ramp plate is pivotable.

9 Claims, 12 Drawing Figures

CASSETTE LOCKING AND ALIGNMENT ASSEMBLY

BACKGROUND OF THE INVENTION

This invention relates generally to sheet holding tray cassettes for photocopy machines and particularly to trays insertable into tray receiving assemblies mounted in photocopiers.

Many photocopy machines provide for paper to be supplied to the machine from removable trays. The trays are filled outside the machine and are then inserted into the machine where they are engaged by or engageable with feeding elements. The feeding elements must ordinarily be disengaged from the tray to allow unhindered removal of the tray, and should be clear of the tray when the tray is reinserted, to prevent damage to the feed apparatus.

In addition, when the tray is in its operative position, wherein the feed mechanism can feed sheets one at a time, removal of the tray could cause severe damage to the feed system. In particular, in those feed systems in which an operating feed system member passes through at least one wall of the tray (as, for example, in the copier sold by Nashua Corporation, Nashua, N.H., under the designation 1220 Copier) both the tray and the machine can be damaged if the tray is removed and/or inserted when that tray is selected.

After a tray is inserted, it is important that the feed rollers engage the stack of paper properly. The rollers are often in pairs, to engage the paper on opposite sides of a center feed line, and it is desirable to have each roller engage the sheet stack firmly with equal pressure. Due to normal manufacturing tolerances, both feed rollers might not engage the paper firmly unless some compensation for "misalignment" is made. One compensation used has been to have the ramp plate in the tray, on which the paper is stacked, freely pivotable about the center, inward of its rear edge. This can be accomplished by creating a downwardly projecting dimple inward from the rear edge of the ramp plate, about which pivoting can be accomplished (as in the Nashua 1220 Copier, referred to earlier).

It is therefore an object of this invention to provide a tray and tray receiving assembly that provides for positive locking of the tray in its operative position to prevent damage to the tray or feed elements by improper removal of the tray from the machine. It is another object to provide for supporting the paper supporting plate to provide a sheet stack that is automatically aligned with the photocopier feed rollers. Other objects are to provide a reliable, positive acting, tray and tray receiving assembly that is efficient and inexpensive to manufacture and maintain.

SUMMARY OF THE INVENTION

The invention provides a positive lock and feed alignment for photocopier sheet stack trays that are insertable into a receiving opening in a photocopier frame, in which the frame includes a lift member movable between a first position where it positions the sheets for engagement by feed rollers, and a second position in which the lift member is out of contact with the tray, the lift member, in the preferred embodiment, being biased toward the first position. A lock for positively engaging the tray to prevent its removal when the lift member is in the first position is mounted for movement cooperatively with the lift member between a first position in which the lock engages the tray and a second position in which it does not. The lock can be biased toward the first position. A positioning handle is cooperatively connected to the lift member to releasably maintain it in the first and second positions.

In a preferred embodiment, the tray has a bottom surface with an opening through which a ramp plate can be engaged by the lift member, and an edge of the opening can be engaged by the lock in its first position. The lift member and lock are mounted in an axially overlapping relationship on a shaft in the frame of the photocopier, the lift member being adapted to engage the lock to maintain the lock in its second position when the lift member is in its second position. The biasing mechanism for the lift member includes a ramp member with a surface engageable by a positioning handle to maintain the lift member in its first and second positions.

Also, in the preferred embodiment, the tray includes a ramp plate engageable by the lift roller and pivotable about a rear edge. The tray further includes a base element slidable on a base surface, on which is formed a projection with a protruding upper surface, the ramp plate being pivotable about said projection.

BRIEF DESCRIPTION OF THE DRAWINGS

Other objects, features and advantages of the invention will be apparent from the following description of a preferred embodiment, including the drawings thereof, in which.

DESCRIPTION OF THE PREFERRED EMBODIMENT

Figure 1:
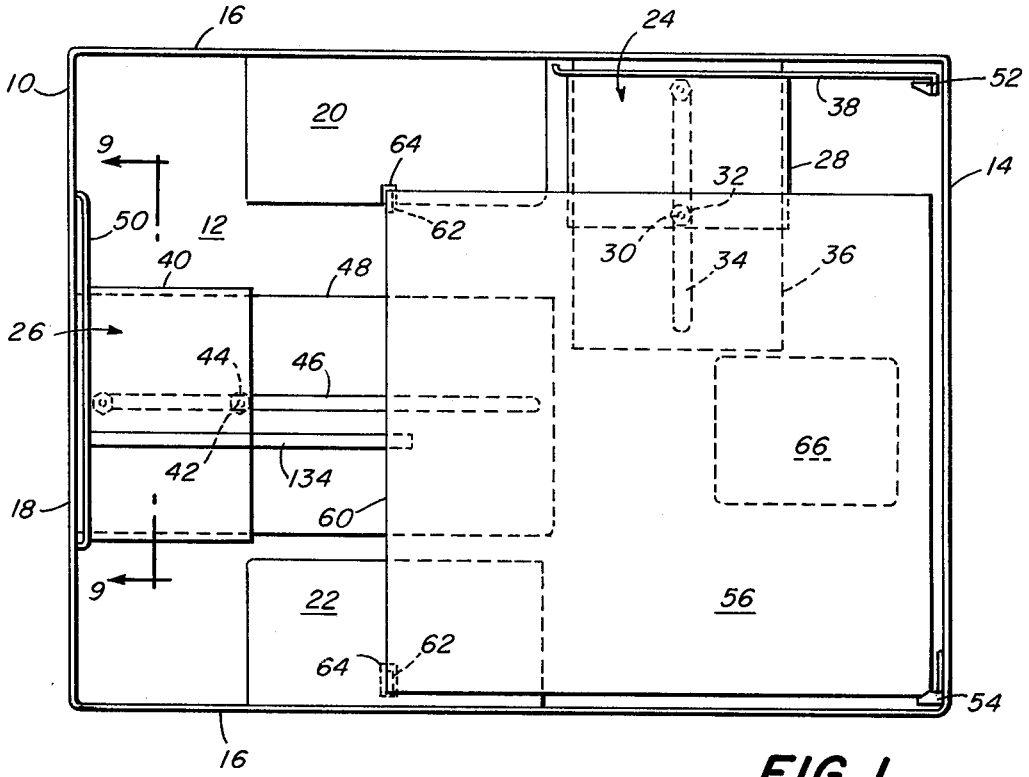
FIG. 1 is a plan view of a sheet holding tray for use with a photocopier.
Figure 2:
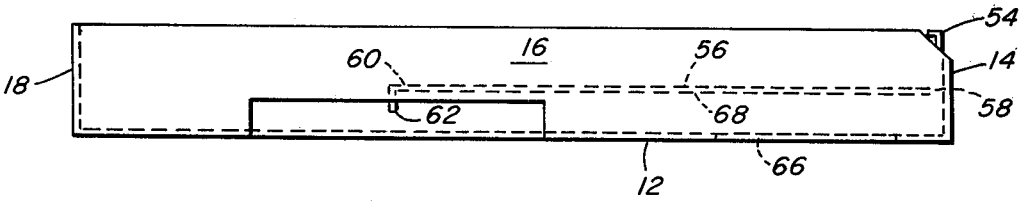
FIG. 2 is a side elevational view of the tray of FIG. 1.

A tray 10, suitable for use in storing a stack of sheets of copy material, typically paper, and for insertion into a photocopier, is shown in FIGS. 1 and 2. The tray 10 has a bottom 12, a front wall 14, side walls 16, and a back wall 18. The interior of the tray 10 includes raised stack support portions 20 and 22. It also includes a side guide 24 and a rear guide 26. The side guide 24 includes a horizontal metal sleeve 28 with downwardly projecting fasteners 30 with nuts 32 cooperating with a slot 34 in a plastic slide 36 on which the metal sleeve 28 is slidable. The side guide 24 includes a vertical wall 38 for adjusting the width of the sheet stack area in the tray 10. The rear guide 26 similarly includes a horizontal metal sleeve 40 with fasteners 42 and nuts 44 cooperating with a slot 46 in a rear plastic slide 48. The rear guide 26 has a vertical wall 50 for adjusting the length of the sheet stack area of the tray 10.

The vertical wall 38 of the side guide 24 includes at its forward end (shown near a front corner of the tray 10) a corner separator member 52, engageable with sheets stacked in the tray 10 when the wall 38 is brought up against the side of the stack by sliding the sleeve 28 on the slide 36. Another corner separator member 54 is mounted at the other front corner on the tray front wall 14 near the side wall 16.

A ramp plate 56 has a front edge 58 near the tray front wall 14. A rear edge 60 of the ramp plate has downwardly extending tabs 62 resting in slots 64 in the stack support portions 20, 22 so that the ramp plate 56 is pivotable about its rear edge 60. The illustrated tray bottom 12 has a rectangular opening 66 through which a bottom surface 68 of the ramp plate 56 can be engaged to lift the plate 56. Thereby sheets stacked in the tray are brought into a feed position to be fed from the tray into the photocopier when the tray is inserted and "armed" as described in detail below.

Figure 3:
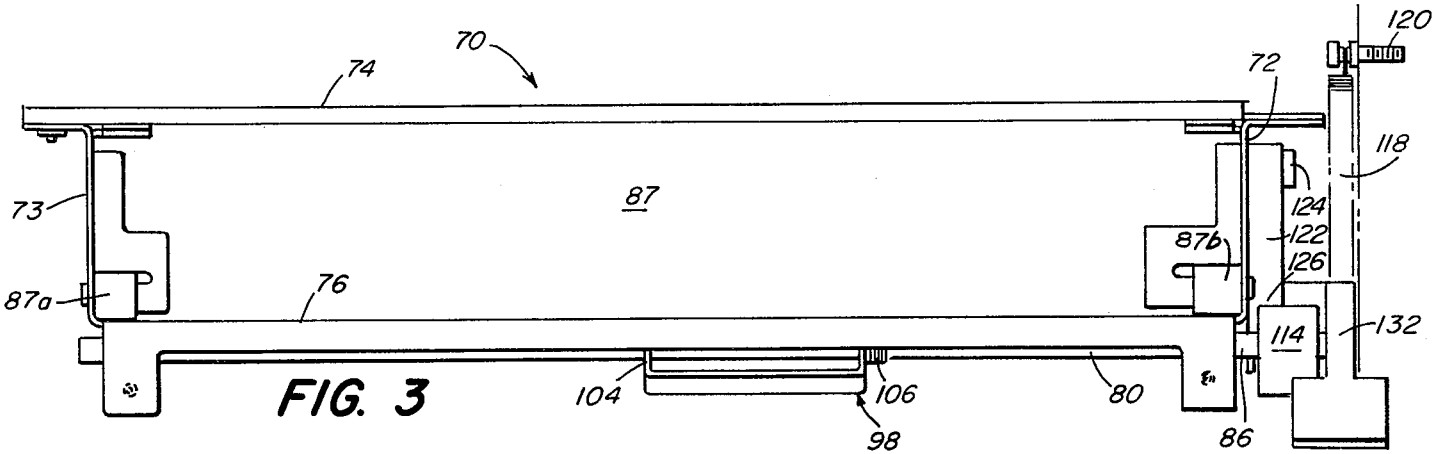
FIG. 3 is a rear elevational view of a tray receiver assembly.
Figure 4:
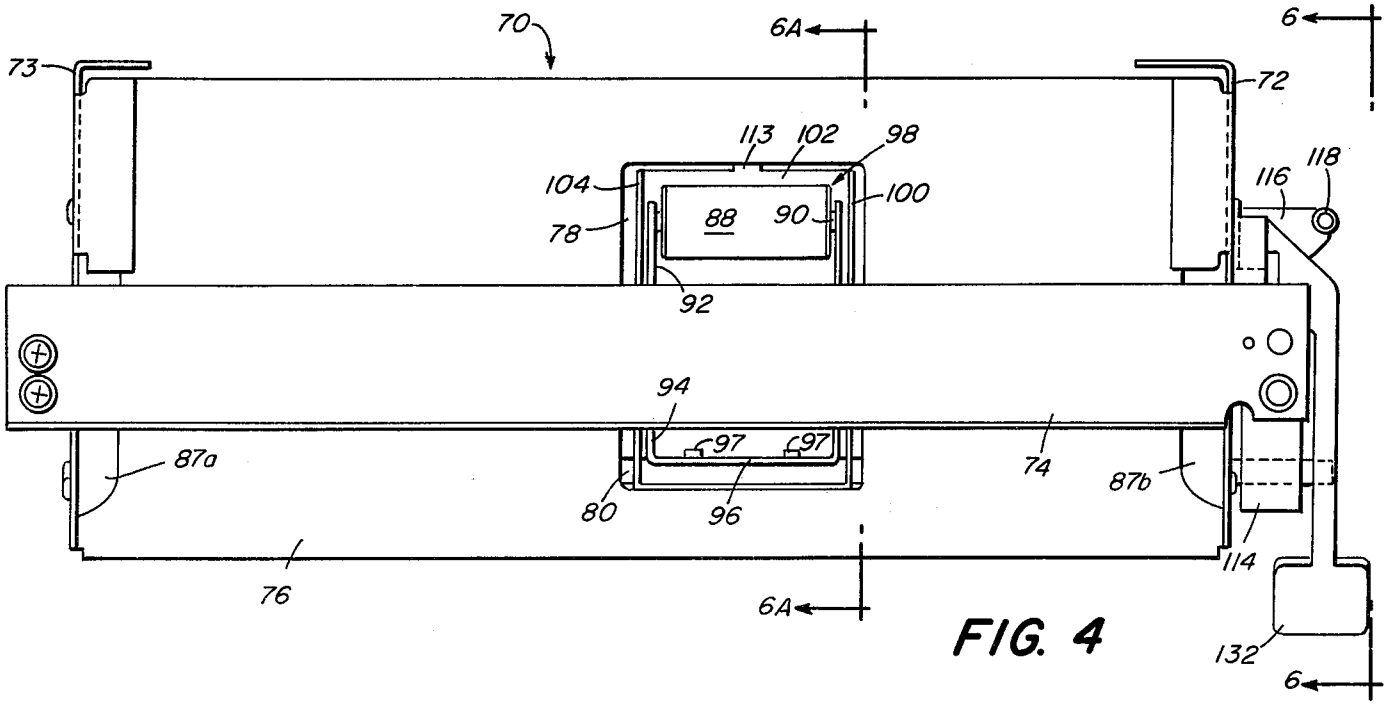
FIG. 4 is a plan view of the tray receiver assembly of FIG. 3.

A tray receiver assembly 70, as shown in FIGS. 3 and 4, is mounted in the photocopier in a conventional manner not shown here. The assembly 70 includes side walls 72 and 73, a horizontal upper stay 74 joining the side walls 72, and a bottom plate 76 with an opening 78 (FIG. 4) aligned with the opening 66 in the bottom 12 of the tray 10 when the tray is fully inserted into the photocopier. A shaft 80 extends beneath the bottom plate 76 through a pillow block 82 (FIG. 5) in one side wall 73 and through another pillow block 84 in the other side wall 72. The shaft 80 is rotatable in the pillow blocks 82, 84. One end 86 of the shaft 80 extends beyond the side wall pillow block 84.

When the tray is inserted into the tray receiver assembly opening 87, it is aligned laterally by plastic alignment bumpers **87*a*, 87*b***, and is inserted into the receiver assembly until it engages forward stops (not shown) in the machine frame.

Figure 5A:
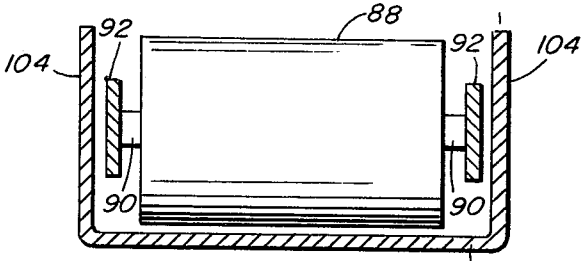
FIG. 5A is a cross-sectional view along lines 5A—5A of FIG. 5.
Figure 5:
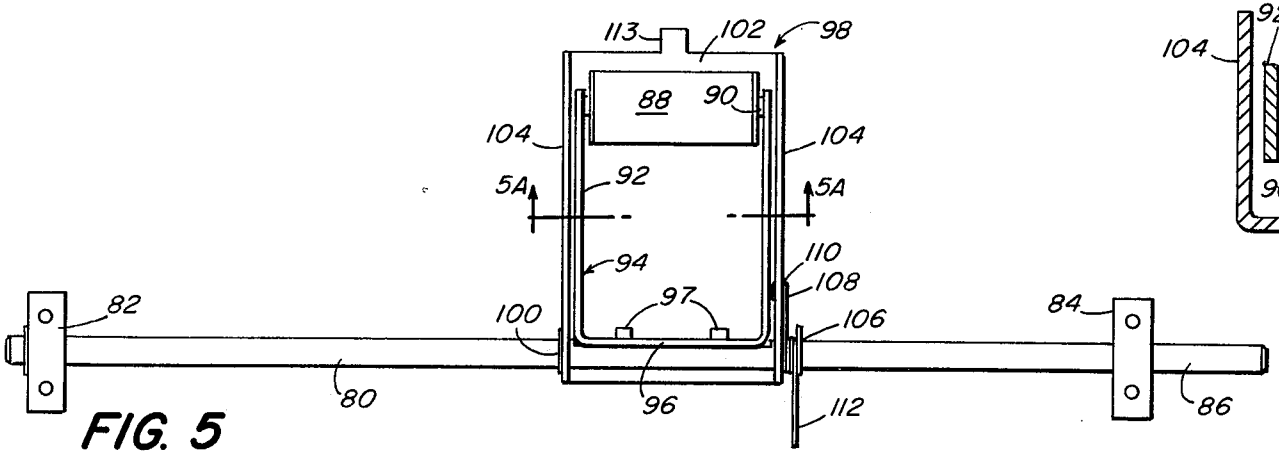
FIG. 5 is a plan view of the shaft sub-assembly of the tray receiver assembly of FIG. 3.

As shown particularly in FIG. 5, mounted on shaft 80, for movement through the bottom plate opening 78, is a paper lift member, here a roller 88. The paper lift roller 88 is rotatably mounted on a roller shaft 90 secured to the arms 92 of a paper lift fork 94. The arms 92 of the paper lift fork 94 terminate in a base 96 attached rigidly to the shaft 80 by fasteners 97, so that as the shaft 80 rotates, the paper lift roller 88 rotates or pivots upwardly through the bottom plate opening 78.

A locking bracket 98 is also mounted on and supported by the shaft 80, by way of bushings 100, so that the locking bracket 98 is rotatable with respect to the shaft 80. The locking bracket 98 has a central plate 102 located beneath the paper lift roller 88, and two upwardly rising side walls 104 located outwardly of the lift roller 88. A locking bracket spring 106 is coiled around the shaft 80. One end 108 of the spring 106 is secured to the locking bracket 98 by extending into a hole 110 in a bracket side wall 104. The other end 112 of the spring is extended and meets the bottom plate 76 of the tray receiver assembly 70. The spring 106 biases the locking bracket 98 upward. When bracket 98 is allowed to rotate upward in response to the bias of the spring 106, tab 113, extending from the front of the bracket central plate 102, prevents the plate 102 from passing through the opening 78 in the bottom plate 76 although the upwardly rising side walls 104 of the bracket do extend through the opening 78 when the tab 113 meets the bottom plate 76 of the assembly 70.

Figure 6A:
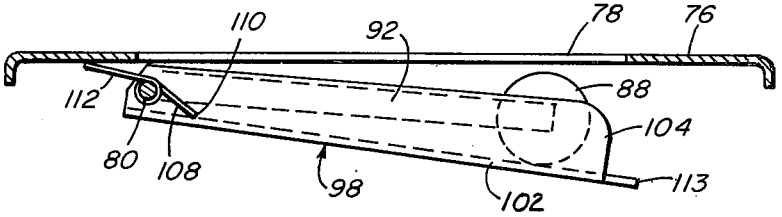
FIG. 6A is a view from the line 6A—6A of FIG. 4, partially in section, of the portion of the tray receiver assembly including the lift member and locking device, in positions corresponding to those shown in FIG. 6.
Figure 6:
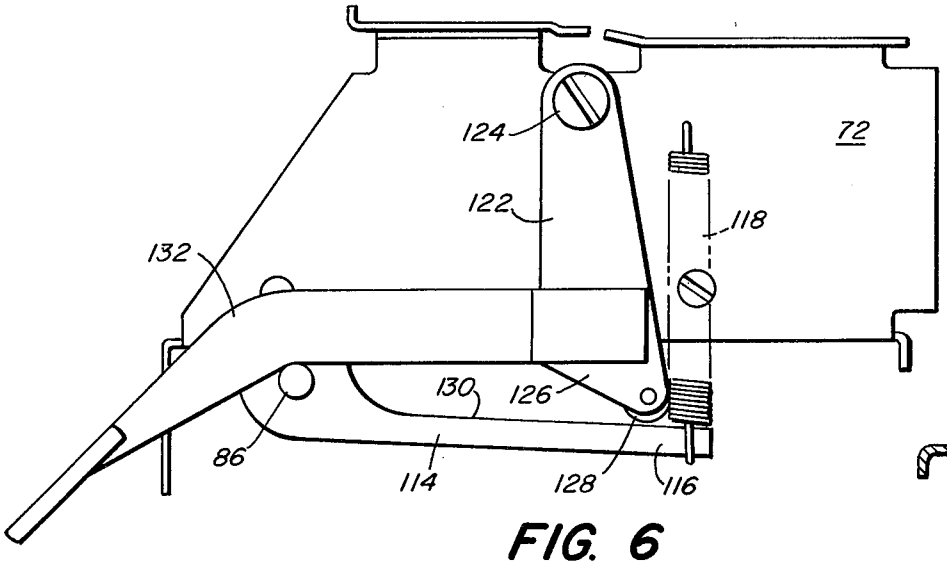
FIG. 6 is a side elevational view of the tray receiver assembly of FIGS. 3 and 4, from the line 6—6 of FIG. 4, showing particularly the locking handle and lever arm without the tray of FIG. 1 inserted.

Referring now to FIG. 6, it can be seen that end 86 of the shaft 80 extending through the assembly side wall 72 is secured to a ramp arm 114. The ramp arm 114 extends horizontally forward to an end 116 secured to one end of a spring 118. The other end of the spring 118 is secured to a spring post 120 (see FIG. 3) that is fastened to the frame of the photocopier, not shown. A contact arm 122 extends downwardly from pivotal attachment via a fastener 124 to the assembly side wall 72, and includes at its lower end 126 a rotatable wheel 128 that allows the arm 122 to slide easily along the upper surface 130 of the ramp arm 114. Rigidly secured to an intermediate portion of the contact arm 122 is a rearwardly horizontally extending locking handle 132.

The arrangement of the ramp arm 114, contact arm 122 and locking handle 132 shown in FIG. 6 corresponds to a position of the tray receiver assembly in which a tray 10 can be safely inserted or removed from the photocopier. With the locking handle 132 down, as shown in FIG. 6, the ramp arm 114 is in a stable down position. The shaft 80 secured to the ramp arm 114 then corresponds to a position in which the lift roller 88 mounted on the shaft 80 is kept below the plane of opening 78 in the assembly bottom plate 76. As shown in FIG. 6A, the lift roller 88 in such a position engages and maintains the locking bracket 98 in a downward position, so that the side walls 104 of the bracket are also below the plane of opening 78.

After the tray 10 is inserted into the tray receiver assembly 70, the locking handle 132 can be manually moved upwardly. Moving the handle 132 moves the contact arm lower end 126 rearward. After a certain amount of rearward rotation by the contact arm 122, the bias of the spring 118 urges further rearward movement, positively urging the contact arm 122 and locking handle 132 to the position shown in FIG. 7. The rotation of the shaft 80 caused by this rearrangement results in the positions of the paper lift roller 88 and the locking bracket 98 shown in FIG. 7A. The paper lift roller 88 is pivotally moved through the assembly bottom plate opening 78 and through the aligned opening 66 of the tray bottom 12, to engage the bottom surface 68 of the ramp plate 56 in the tray 10. The ramp plate 56 accordingly pivots about its rear edge 60 in the tray to lift upwardly the stack of sheets on it to a suitable feed position for engagement by the feed rollers of the photocopier. The locking bracket 98, freed by the upward movement of the paper lift roller 88, responds to the bias of its spring 106 to move upwardly. The tab 113 limits upward movement of the locking bracket 98 but allows the side walls 104 of the bracket to extend above the assembly bottom plate opening 78. In this position, the side walls 104 extend up through the tray bottom opening 66. There the side walls 104 prevent any rearward movement of the tray 10, as for example, in response to an attempt to remove the tray 10 while the paper lift roller 88 is engaging the ramp plate 56 in the tray 10.

Figure 8:
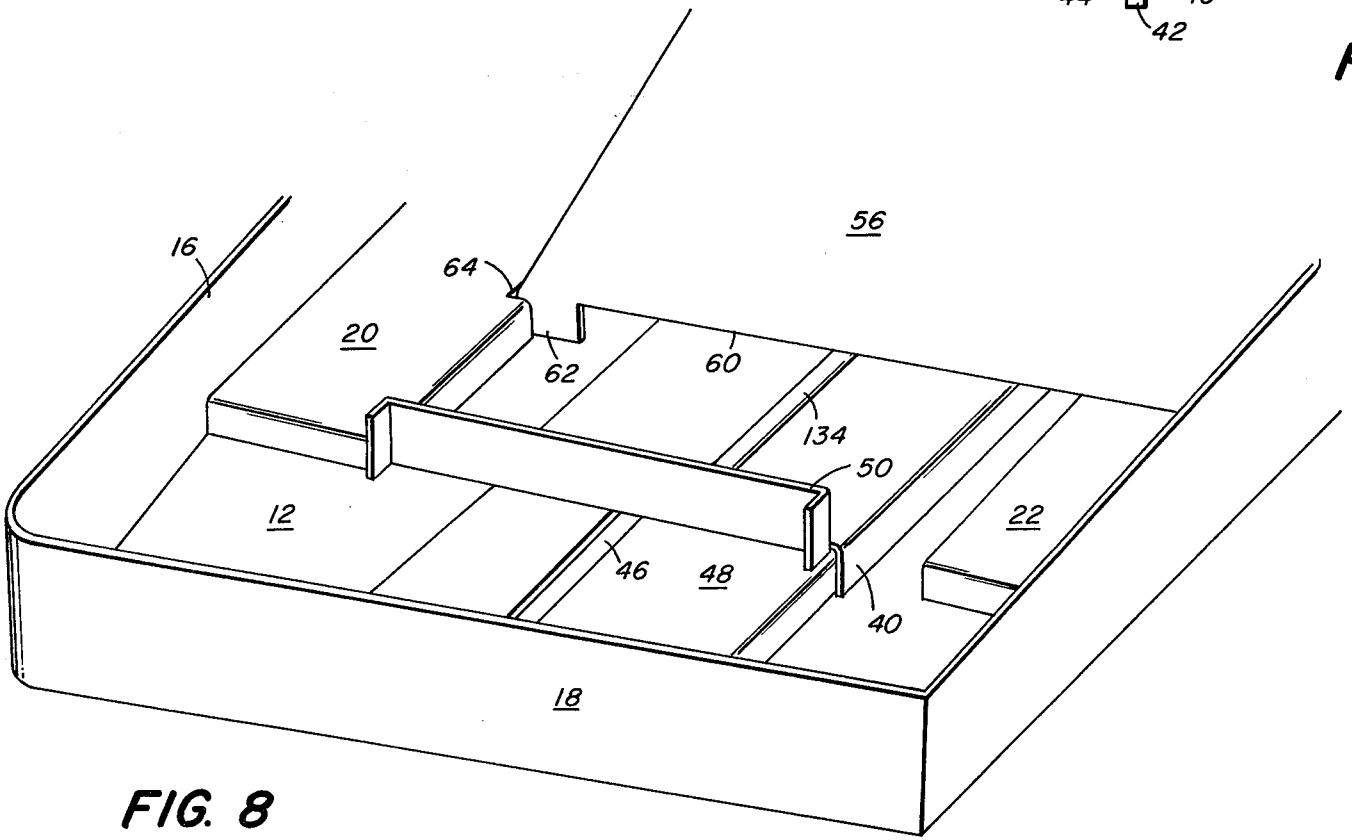
FIG. 8 is a perspective view of the rear portion of the ramp plate and adjacent portions of the tray, when it is inserted and engaged in the tray receiver assembly.

FIG. 8 shows the rear portion of the ramp plate 56 in the tray 10, with the tray inserted in the tray receiver assembly 70 and with the front portion of the plate 56 in a lifted or raised condition. In the illustrated embodiment, the ramp plate 56 pivots about its rear edge 60 in response to the upward movement of the front of the ramp plate, and paper stacked on it (not shown in the drawing) is raised to a feed position for engagement by feed rollers (also not shown). The feed rollers are arranged on a shaft generally parallel to the front edge 58 and rear edge 60 of the ramp plate 56.

Figure 9:
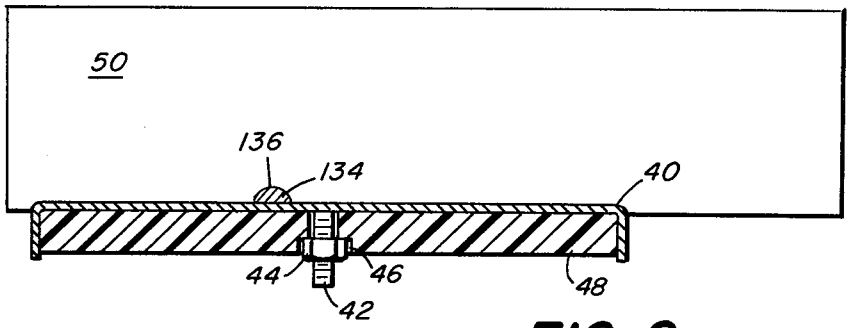
FIG. 9 is a sectional view from the line 9—9 of FIG. 1, of the rear guide portion of the tray, showing particularly the pivot rod.

The ramp rear edge 60 rests on a pivot rod 134 on top of the rear guide metal sleeve 40. As can be seen in FIG. 9, the illustrated pivot rod 134 has a semicircular cross section with its convex surface 136 facing upwardly. The elongate rod 134 extends in a direction transverse to the rear edge 60 of the ramp plate 56, and is secured to the metal sleeve 40 for example with an adhesive. The illustrated rod 134 extends from near the rear guide wall 50 forward and beyond the sleeve 40, so that the ramp plate rear edge 60 rests upon some part of the pivot rod 134 whatever the relative position of the metal sleeve 40 of the rear guide 26. Thus different paper sizes have no effect upon the ramp pivot function.

The rod 134 extends substantially beneath the central portion of the ramp plate rear edge 60, so that the ramp plate 56 can pivot about the contact point of the rear edge 60 with the top of the curved surface 136 of the rod 134. The ramp plate 56 will pivot in response to the pressure of the feed rollers on the stack of sheets supported by the ramp plate 56 to automatically align itself with the feed rollers.

Figure 7:
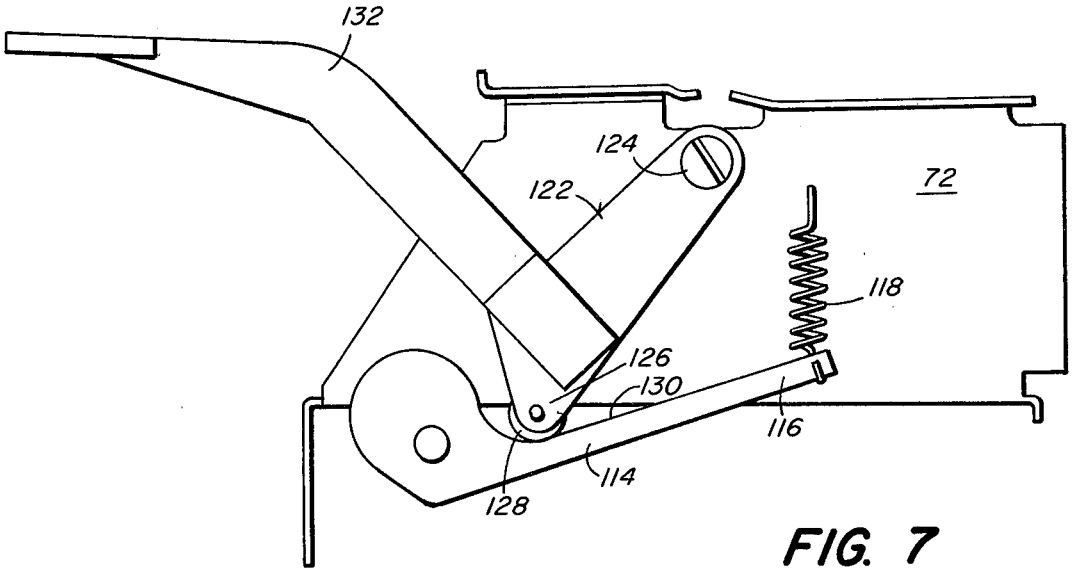
FIG. 7 is a view like that of FIG. 6, in which the elements have the positions taken when the tray of FIG. 1 is inserted and engaged in the tray receiver assembly.
Figure 7A:
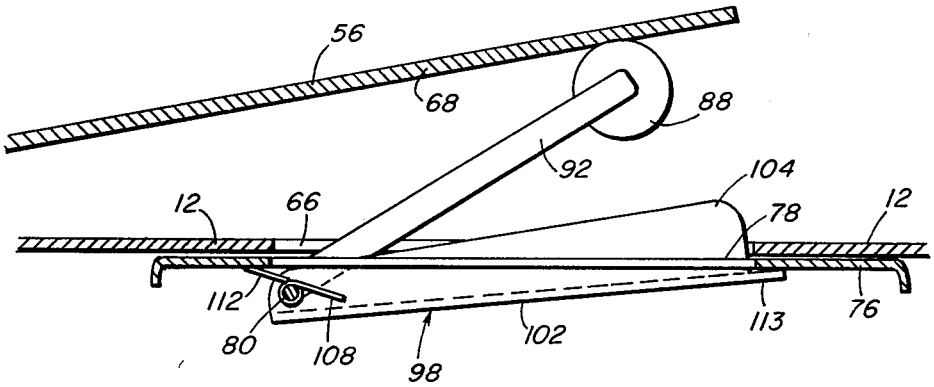
FIG. 7A is a view like that of FIG. 6A, corresponding to the position of the elements in FIG. 7.

In operation, then, when the locking handle 132 is in the lower position, as shown in FIG. 6, the paper lift roller 88 and the locking bracket 98 are in a position below the opening 78 of the tray receiver bottom plate 76, as shown in FIG. 6A, and the tray 10 may be inserted into, or withdrawn from, the tray receiver assembly 70. When the tray 10 is inserted into the assembly 70 the opening 66 in the tray bottom 12 becomes aligned with the opening 78 in the assembly bottom plate 76. The locking handle 132 can be brought to an upward position, as shown in FIG. 7. The shaft 80 rotates in response to the movement of the ramp arm 114, to which the shaft end 86 is secured. This causes the paper lift roller 88 to pivot upwardly through the opening 78, as shown in FIG. 7A, and engage the ramp plate bottom surface 68 through the tray bottom opening 66. Meanwhile, and simultaneously, the locking bracket 98 is released by the movement of the paper lift roller 88 upward from the position in which it had restrained the upward movement of the bracket. The bracket 98 therefore responds to the force of the spring 106 and moves upward. The tab 113 on the end of the bracket 98 meets the bottom plate 76, preventing movement of the bracket beyond that point, but the upwardly rising side walls 104 of the bracket do extend through the bottom plate opening 78 and through the aligned tray bottom opening 66. Accordingly the bracket side walls 104 in this position prevent removal of the tray 10 because of their positive interference with the edges of the tray bottom opening 66.

The lift given the ramp plate 56 by the paper lift roller 88 positions the ramp plate for engagement with the feed rollers, which can descend to meet the stack, or which can be fixed in position above the stack. By virtue of the free pivotal movement of the ramp plate rear edge 60 about the extended pivot rod 134 alignment between the stack and the feed wheels is assured.

MAJOR ADVANTAGES OF THE INVENTION

The assembly provided by the invention provides an integrated operation for lifting the ramp plate of a photocopier feed tray into an operational position with the feed rollers and for simultaneously positively locking the tray into position, after it is inserted into a photocopier. It performs this function with positive steps, so that it is clear which position, open or closed, the tray receiver assembly is in. Thereby, the attempted removal of the tray, where it is in an operating condition wherein the lift member is in engagement with the ramp plate, will not damage the lift member and its associated components.

In addition, the use of what is effectively an extended pivot point for the ramp plate provides freedom of design for making the described tray "universal" so that it receives and feeds plural sizes of sheet material.

Modifications of the disclosed embodiment are contemplated and would be within the scope of the invention. For example, the upper surface of the pivot rod need not be semicircular in shape, though a surface appropriate for pivotal movement is required. The particular configuration of the locking bracket may be changed, as long as positive locking of the tray is accomplished when the locking bracket is freed for movement by the movement of the lift member. Thus additions, subtractions, deletions and other modifications of the disclosed embodiment will be obvious to those skilled in the art and are within the scope of the following claims.

We claim:

1. A photocopier sheet holding assembly comprising:

a tray for holding sheet material in a stack and adapted to be inserted into a receiving opening in the frame of a photocopier for engagement of said sheets and a plurality of feed rollers.

a shaft, a lift member, and means for rotatably mounting said lift member on said shaft for movement between a first position in which said lift member positions said sheets for engagement with said feed rollers and a second position in which said lift member is out of contact with said tray, first biasing means for biasing said lift member toward said first position, wherein the improvement comprises:

a lock means for positively engaging said tray to prevent the removal of said tray from said frame when said member is in said first position, means for rotatably, coaxially mounting said lock means on said shaft for movement between a first position in which said lock means engages said tray and a second position in which said lock means does not engage said tray, and second biasing means for biasing said lock means toward said first position, positioning means cooperatively connected at least to said lift mounting means for releasably maintaining said lift member in said first and second positions, said lift member and said lock means being mounted for direct physical contact and cooperative movement whereby said lift member and said lock means move together between said first and second positions.

2. A photocopier sheet holding assembly comprising:

a tray for holding sheet material in a stack and adapted to be inserted into a receiving opening in the frame of a photocopier for engagement of said sheets and a plurality of feed rollers, a lift member, and means for mounting said lift member for movement between a first position in which said lift member positions said sheets for engagement with said feed rollers and a second position in which said lift member is out of contact with said tray, first biasing means for biasing said lift member toward said first position, wherein the improvement comprises:

a lock means for positively engaging said tray to prevent the removal of said tray from said frame when said member is in said first position, means for mounting said lock means for movement between a first position in which said lock means engages said tray and a second position in which said lock means does not engage said tray, and second biasing means for biasing said lock means toward said first position, positioning means cooperatively connected at least to said lift mounting means for releasably maintaining said lift member in said first and second positions, said lift member and said lock means being mounted for cooperative movement whereby said lift member and said lock means move together between said first and second positions, said lift member being adapted to engage said lock means to maintain said lock means in its second position when said lift member is in its second position, and said lift member being disengaged from said lock means when said lift member is in its first position.

3. The assembly of claim 2 wherein said tray includes a surface with an edge defining an opening through which said lift member passes in moving between said first and second positions, and said tray surface is engaged by said lock means in its first position.

4. The assembly of claim 2 further including a shaft mounted in a frame of said photocopier whereby said lift member and said lock means are both moveably mounted in an axially overlapping relationship on said shaft.

5. The assembly of claim 1 wherein said first biasing means includes a ramp means pivotally mounted in said photocopier frame, and said positioning means includes a surface engaging said ramp means to positively maintain said lift member in said first and second positions.

6. A photocopier sheet holding assembly comprising:

a tray for holding sheet material in a stack and adapted to be inserted into a receiving opening in the frame of a photocopier for engagement of said sheets and a plurality of feed rollers, a lift member, and means for mounting said lift member for movement between a first position in which said lift member positions said sheets for engagement with said feed rollers and a second position in which said lift member is out of contact with said tray, first biasing means for biasing said lift member toward said first position, wherein the improvement comprises:

a lock means for positively engaging said tray to prevent the removal of said tray from said frame when said member is in said first position, means for mounting said lock means for movement between a first position in which said lock means engages said tray and a second position in which said lock means does not engage said tray, and second biasing means for biasing said lock means toward said first position, positioning means cooperatively connected at least to said lift mounting means for releasably maintaining said lift member in said first and second positions, said lift member and said lock means being mounted for cooperative movement whereby said lift member and said lock means move together between said first and second positions, said tray including:

a ramp plate having a lower surface engageable by said lift member, said ramp plate having a rear edge about which it is pivotable, and a base surface on which is formed an elongate projection extending transversely to said ramp plate rear edge, said projection having a protruding upper surface, said ramp plate rear edge resting on said projection and being pivotable about said projection.

7. The assembly of claim 6 wherein a slidable base element is slidable on said base surface in a direction transverse to said ramp plate edge, and said projection is formed on said base element.

8. A photocopier sheet holding assembly comprising:

a tray for holding sheet material in a stack and adapted to be inserted into a receiving opening in the frame of a photocopier for engagement of said sheets and a plurality of feed rollers, said tray including a surface with an edge defining an opening, a lift member, shaft means for mounting said lift member for movement through said tray opening between a first position in which said lift member positions said sheets for engagement with said feed rollers and a second position in which said lift member is out of contact with said tray, and first biasing means for biasing said lift member toward said first position, wherein the improvement comprises:

a lock means for positively engaging said tray opening edge to prevent the removal of said tray from said frame when said member is in said first position, means for mounting said lock means on said shaft in an axially overlapping relationship with said lift member for movement between a first position in which said lock means engages said tray opening edge and a second position in which said lock means does not engage said edge, second biasing means for biasing said lock means toward said first position, and positioning means cooperatively connected at least to said lift mounting means for releasably maintaining said lift member in said first and second positions, said first biasing means including a ramp means pivotally mounted in said photocopier frame, and said positioning means including a surface engaging said ramp means to positively maintain said lift member in either of said first and second positions, said lift member being adapted to engage said lock means to maintain said lock means in its second position when said lift member is in its second position, and said lift member being disengaged from said lock means when said lift member is in its first position.

9. A photocopier sheet holding assembly comprising:

a tray for holding sheet material in a stack and adapted to be inserted into a receiving opening in the frame of a photocopier for engagement of said sheets and a plurality of feed rollers, a ramp plate supported by said tray, said ramp plate supporting said stack, and means for pivotally moving said ramp plate about a rear edge of said plate to move said stack into an engagement position with said feed rollers, wherein the improvement comprises:

said tray including a base surface on which is formed an elongate projection extending transversely to said ramp plate edge, said projection having a protruding upper surface, said ramp plate edge resting on said projection and being pivotable about said projection.

* * * * *